US009067427B2

(12) United States Patent
Hayashi

(10) Patent No.: US 9,067,427 B2
(45) Date of Patent: Jun. 30, 2015

(54) LIQUID DISCHARGE HEAD AND IMAGE FORMING APPARATUS

(71) Applicant: Keisuke Hayashi, Kanagawa (JP)

(72) Inventor: Keisuke Hayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 69 days.

(21) Appl. No.: 13/868,254

(22) Filed: Apr. 23, 2013

(65) Prior Publication Data

US 2013/0307911 A1 Nov. 21, 2013

(30) Foreign Application Priority Data

May 16, 2012 (JP) ..... 2012-112427

(51) Int. Cl.

| | |
|---|---|
| ***B41J 2/165*** | (2006.01) |
| ***B41J 2/175*** | (2006.01) |
| ***B05B 15/00*** | (2006.01) |
| ***B05B 17/00*** | (2006.01) |
| ***B41J 2/14*** | (2006.01) |
| *B05B 17/06* | (2006.01) |

(52) U.S. Cl.

CPC ..... *B41J 2/17563* (2013.01); *B05B 15/008* (2013.01); *B05B 17/0623* (2013.01); *B05B 17/0638* (2013.01); *B41J 2/14274* (2013.01); *B41J 2002/14403* (2013.01); *B41J 2002/14419* (2013.01)

(58) Field of Classification Search

None

See application file for complete search history.

(56) References Cited

U.S. PATENT DOCUMENTS

| | | | |
|---|---|---|---|
| 8,172,389 | B2 | 5/2012 | Sugahara |
| 8,348,407 | B2 | 1/2013 | Matsufuji et al. |
| 2006/0055739 | A1* | 3/2006 | Kim et al. ..... 347/67 |

FOREIGN PATENT DOCUMENTS

| | | |
|---|---|---|
| JP | 2008-183800 | 8/2008 |
| JP | 2011-025663 | 2/2011 |

OTHER PUBLICATIONS

U.S. Appl. No. 13/778,271, filed Feb. 27, 2013.
U.S. Appl. No. 13/719,553, filed Dec. 19, 2012.
U.S. Appl. No. 13/780,345, filed Feb. 28, 2013.
U.S. Appl. No. 13/804,625, filed Mar. 14, 2013.
U.S. Appl. No. 13/739,282, filed Jan. 11, 2013.

* cited by examiner

*Primary Examiner* — Alejandro Valencia
(74) *Attorney, Agent, or Firm* — Cooper & Dunham LLP

(57) ABSTRACT

A liquid discharge head includes nozzles that discharge liquid droplets, individual channels in communication with the nozzles, a liquid introducing part in communication with the individual channels, a common liquid chamber that supplies liquid to the individual channels, and a filter part arranged between the common liquid chamber and the liquid introducing part. The filter part has filter holes for filtering the liquid over a range of the individual channels in a nozzle array direction. The filter part has at least one reinforcement rib arranged in the nozzle array direction. The reinforcement rib is partially arranged over the range of the individual channels in a direction perpendicular to the nozzle array direction. Filter regions divided by the reinforcement rib are arranged to be in communication via a communication region where the reinforcement rib is not arranged, and the filter holes are arranged at the communication region.

8 Claims, 12 Drawing Sheets

LIQUID DISCHARGE HEAD AND IMAGE FORMING APPARATUS

BACKGROUND OF THE INVENTION

1. Field of the Invention

The disclosures herein generally relate to a liquid discharge head and an image forming apparatus.

2. Description of the Related Art

Image forming apparatuses such as printers, facsimile machines, copiers, plotters, and multifunction peripherals (MFP) combining one or more of the above functions may be inkjet recording apparatuses corresponding to liquid discharge type image forming apparatuses that use a recording head including a liquid discharge head (liquid droplet discharge head) that discharges liquid droplets, for example.

It is noted that liquid discharge defects may occur at the liquid discharge head when foreign matter enters the liquid discharge head and mixes with liquid contained therein. Thus, the liquid discharge head has a filter member arranged in its channel for filtering the liquid.

For example, Japanese Laid-Open Patent Publication No. 2011-025663 (Patent Document 1) discloses a liquid discharge head having a filter member that filters liquid over an entire area of plural liquid chambers in the nozzle array direction, the filter member including plural reinforcement ribs arranged in the nozzle array direction at intervals of at least two of the liquid chambers. The filter member is divided into plural filter regions by the reinforcement ribs.

However, in the case where the filter member is divided into plural filter regions by arranging reinforcement ribs as in Patent Document 1, liquid may be prevented from flowing at portions where the reinforcement ribs are arranged and stagnation may occur so that air bubble discharge performance may be compromised.

SUMMARY OF THE INVENTION

It is a general object of at least one embodiment of the present invention to provide a liquid discharge head that substantially obviates one or more problems caused by the limitations and disadvantages of the related art.

In one embodiment of the present invention, a liquid discharge head includes plural nozzles that discharge liquid droplets, plural individual channels that are in communication with the nozzles, a liquid introducing part that is in communication with the individual channels, a common liquid chamber that supplies liquid to the individual channels, and a filter part that is arranged between the common liquid chamber and the liquid introducing part. The filter part has plural filter holes configured to filter the liquid over a range of the individual channels in a nozzle array direction. The filter part has at least one reinforcement rib arranged in the nozzle array direction. The reinforcement rib is partially arranged over the range of the individual channels in a direction perpendicular to the nozzle array direction. The filter part is divided into filter regions by the reinforcement rib and the filter regions are arranged to be in communication via a communication region where the reinforcement rib is not arranged, and the filter holes are arranged at the communication region where the reinforcement rib is not arranged.

According to an aspect of the present invention, air bubble discharge performance of a liquid discharge head may be improved, for example.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
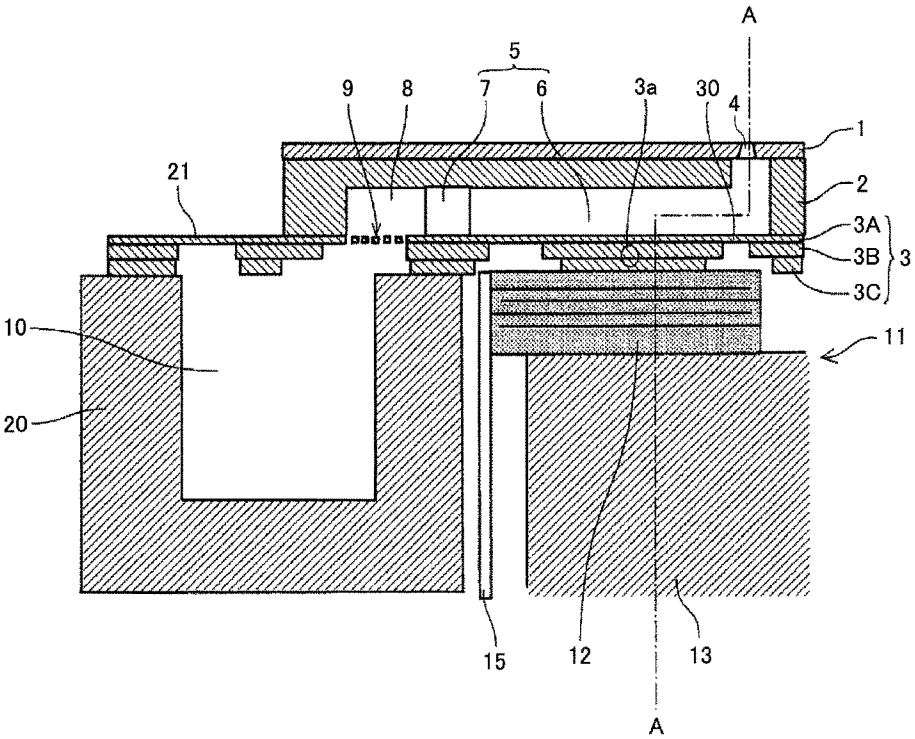
FIG. 1 is cross-sectional view of a liquid discharge head according to an embodiment of the present invention.

In the following, embodiments of the present invention are described with reference to the accompanying drawings. It is noted that identical or corresponding features shown in more than one of the drawings may be given the same reference numerals and their descriptions may be omitted.

Figure 2:
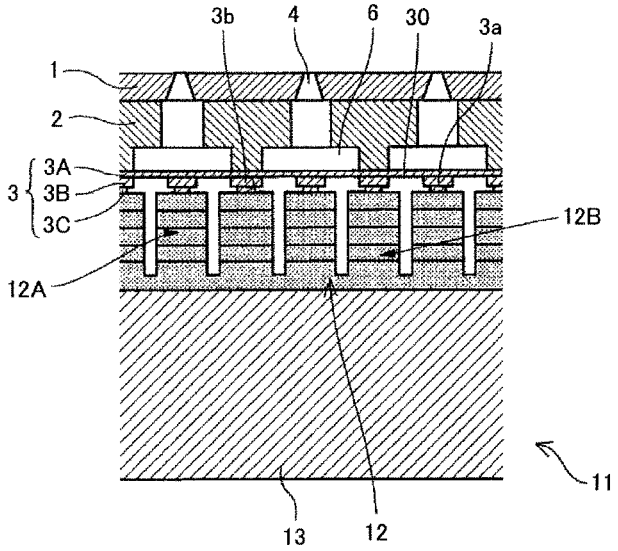
FIG. 2 is a cross-sectional view of the liquid discharge head across section A-A of FIG. 1.

First, a liquid discharge head according to an embodiment of the present invention is described below with reference to FIGS. 1-2. FIG. 1 is cross-sectional view of the liquid discharge head along a direction orthogonal to a nozzle array direction (liquid chamber longitudinal direction); and FIG. 2 is a cross-sectional view of the liquid discharge head across section A-A of FIG. 1 along the nozzle array direction (liquid chamber lateral direction).

The liquid discharge head includes a nozzle plate 1, a channel plate (liquid chamber substrate) 2, and a vibrating plate member 3 made of a thin film. The nozzle plate 1, the channel plate 2, and the vibrating plate member 3 are layered and bonded together. The liquid discharge head also includes a piezoelectric actuator 11 that deforms the vibrating plate member 3, and a frame member 20 corresponding to a common channel member.

The nozzle plate 1, the channel plate 2, and the vibrating plate member 3 form plural liquid chambers (also referred to as "pressure liquid chamber," "pressure chamber," "pressurization chamber," or "channel," for example) 6 that are in communication with plural nozzles 4 that discharge liquid droplets, a liquid supply path 7 that supplies liquid to the liquid chambers 6 and also acts as a fluid resistor, and a liquid introducing part 8 that is in communication with the liquid supply path 7. It is noted that in the present embodiment, an individual channel 5 is formed by the liquid chamber 6 and the liquid supply path 7 including the fluid resistor. However, in other embodiments, the fluid resistor may be omitted and liquid may be supplied directly from the liquid introducing part 8 to the liquid chamber 6 in which case the liquid chamber 6 may form the individual channel 5.

The frame member 20 includes a common liquid chamber 10 corresponding to a common channel. Liquid is supplied to the plural liquid chambers 6 from the common liquid chamber 10, via a filter part 9, the liquid introducing part 8, and the liquid supply path 7.

In the present embodiment, an electroformed nickel (Ni) plate is used as the nozzle plate 1. However, the present invention is not limited to such an embodiment and other metal members, resin members, and resin-metal laminated members may be used instead, for example. The nozzle plate 1 has a nozzle 4 having a diameter of 10-35 μm, for example, for each of the liquid chambers 6. The nozzle plate 1 is bonded to the channel plate 2 with adhesive. Further, a water repellent layer is arranged on the liquid droplet discharge face of the nozzle plate 1 (i.e., discharging direction side surface, discharging face, or face on the opposite side of the liquid chamber 6).

In the present embodiment, the channel plate 2 is created by etching a single crystal silicon substrate to form trenches corresponding to the liquid chambers 6, the liquid supply path 7, and the liquid introducing part 8, for example. It is noted that in other embodiments the channel plate 2 may be created by etching a metal plate such as a SUS substrate using an acid etching solution, or by mechanically processing (e.g., pressing) a metal plate, for example.

The vibrating plate member 3 also acts as a wall member that forms a wall of the liquid chamber 6 of the channel plate 2. The vibrating plate member 3 includes first through third layers 3A-3C. The first layer 3A forms a deformable vibrating region 30 at a portion corresponding to the liquid chamber 6.

The piezoelectric actuator 11 including an electromechanical conversion element as a drive means (actuator means, pressure generating means) for deforming the vibrating region 30 is arranged on the vibrating plate member 3 at the opposite side of the liquid chamber 6.

The piezoelectric actuator 11 includes layered piezoelectric members 12 that are bonded to a base member 13 with adhesive. Each of the piezoelectric members 12 is groove-processed by half-cut dicing to form a desired number of piezoelectric pillars 12A and 12B at certain intervals in the form of a comb.

The piezoelectric pillars 12A and 12B of the piezoelectric members 12 have substantially identical configurations and differ in that a driving waveform is applied to the piezoelectric pillars 12A to drive the piezoelectric pillars 12A while no driving waveform is applied to the piezoelectric pillars 12B so that the piezoelectric pillars 12B are used simply as support pillars.

The driven piezoelectric pillar 12A is bonded to a corresponding convex portion 3*a* formed by the second layer 3B and the third layer 3C at the vibrating region 30 of the vibrating plate member 3. The non-driven piezoelectric pillar 12B is bonded to a corresponding convex portion 3*b* of the vibrating member plate 3.

The piezoelectric member 12 is a layered structure formed by alternately layering a piezoelectric material layer and an internal electrode. The internal electrode is drawn out to an end face and is connected to an external electrode. Further, a FPC (flexible printer circuit) 15 as a flexible wiring substrate for supplying a drive signal to the external electrode is connected to the driven pillar 12A.

The frame member 20 is created through injection molding using a resin material such as epoxy resin or a polyphenylenesulfide (PPS) resin corresponding to a thermo-reversible resin, for example. The frame member 20 forms the common liquid chamber 10 to which liquid is supplied from a head tank or a liquid cartridge (not shown), for example.

Also, a deformable damper region 21 is formed by one of the layers 3A-3C of the vibrating plate member 3 as a portion of the wall of the common liquid chamber 10.

In the liquid discharge head having the above configuration, for example, a voltage applied to the driven pillar 12A may be lowered with respect to a reference potential so that the driven pillar 12A may contract and the vibrating region 30 of the vibrating plate member 3 may be deformed. As a result, the capacity (volume) of the liquid chamber 6 may increase to cause liquid to flow inside the liquid chamber 6. Then, the voltage applied to the driven pillar 12A may be raised so that the driven pillar 12A may expand in the layering direction and the vibrating region 30 of the vibrating plate member 3 may be deformed in a direction of the nozzle 4 to decrease the capacity (volume) of the liquid chamber 6. As a result, the liquid within the liquid chamber 6 may be pressurized so that liquid droplets may be discharged from the nozzle 4.

Then, the voltage applied to the driven pillar 12A may be set back to the reference potential so that the vibrating region 30 of the vibrating plate member 30 may be restored to its initial position. In this case, because the liquid chamber 6 is expanded and a negative pressure is generated, liquid from the common liquid chamber 10 is supplied to the liquid chamber 6 via the liquid supply path 7. Thus, the next liquid droplet discharge operations are performed after meniscus vibration at the nozzle 4 is attenuated and stabilized.

It is noted that the method of driving the liquid discharge head is not limited to the above-described example (i.e., pull-push method). In other examples, the so-called push method or the pull method may be used in accordance with the direction in which the driving waveform is applied.

In the following, a liquid discharge head according to a first embodiment of the present invention is described with reference to FIGS. 3-5.

Figure 3:
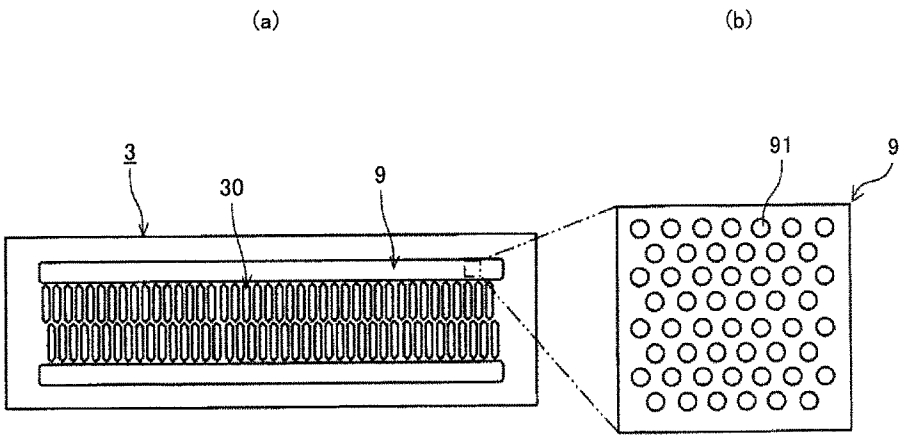
FIG. 3 is a plan view of a vibrating plate member of the liquid discharge head according to a first embodiment of the present invention.

FIG. 3 is a plan view of the vibrating plate member 3; FIG. 4 is a plan view of a channel portion near the liquid supply path 7; and FIG. 5 is an enlarged plan view of the filter part 9.

Referring to FIG. 3, the vibrating plate member 3 has the filter part 9 arranged between the common liquid chamber 10 and the liquid introducing part 8 for filtering liquid across the entire range of the individual channels 5 in the nozzle array direction. The filter part 9 has plural filter holes 91 for filtering the liquid.

Figure 4:
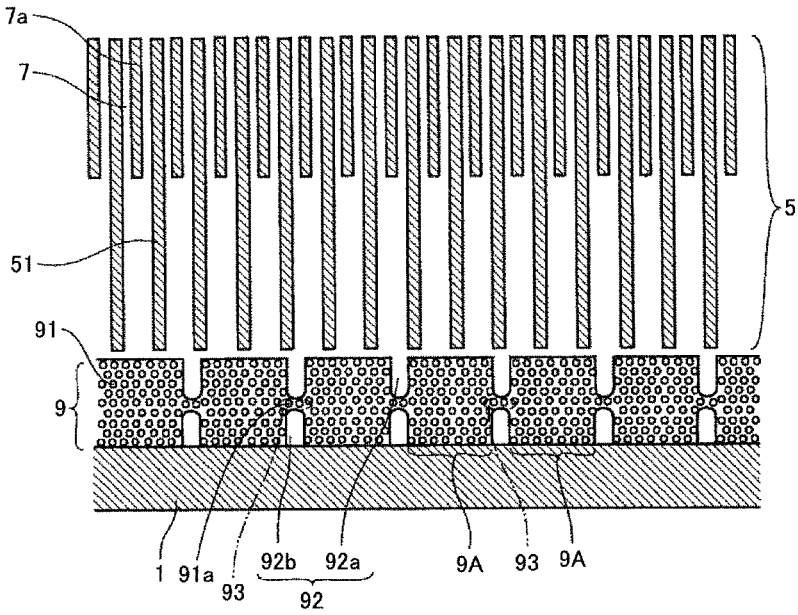
FIG. 4 is a plan view of a channel portion near a liquid supply path of the liquid discharge head according to the first embodiment.

Referring to FIG. 4, the individual channels 5 are separated by partition walls 51 that are adjacent to each other. It is noted that a fluid resistance part is formed by arranging a convex portion 7*a* midstream of the liquid supply path 7.

Figure 5:
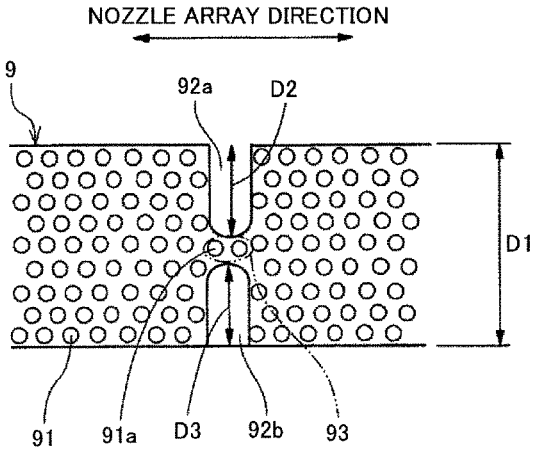
FIG. 5 is an enlarged plan view of a filter part of the liquid discharge head according to the first embodiment.

As illustrated in FIGS. 4 and 5, the filter part 9 has plural reinforcement ribs 92 (including ribs 92*a* and 92*b*) arranged in the nozzle array direction. The reinforcement ribs 92 may be formed by the second layer 3B that is arranged on the first layer 3A of the vibrating plate member 3 forming the filter part 9, for example. In another example, the reinforcement ribs 92 may be formed by layering both the second layer 3B and the third layer 3C of the vibrating plate member 3.

The reinforcement ribs 92 are partially arranged over a width D1 of the filter part 9 in a direction orthogonal to the nozzle array direction. That is, assuming the respective widths of the ribs 92*a* and 92*b* of the reinforcement ribs 92 are denoted as D2 and D3, D1>D2+D3.

In this way, adjacent filter regions 9A that are divided by the reinforcement ribs 92 may be in communication with each other via a region (referred to as "communication region" hereinafter) 93 where the reinforcement rib 92 is not arranged. That is, in the present embodiment, the filter regions 9A are in communication with each other via the communication regions 93 arranged between the ribs 92*a* and 92*b*. It is noted that filter holes 91*a* are formed at the communication regions 93.

Figure 6:
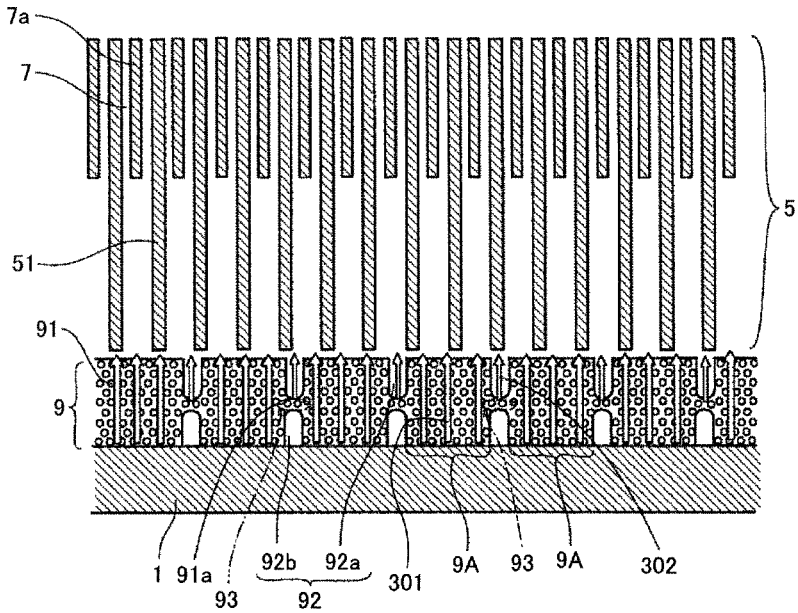
FIG. 6 is a plan view illustrating a liquid flow at the channel portion of the first embodiment.

FIG. 6 illustrates a flow of liquid from the common liquid chamber 10 passing through the filter part 9 to reach the individual channels 5 when the reinforcement ribs 92 are arranged in the above-described manner. That is, in the present embodiment, a liquid flow represented by arrows 301 occurs at the filter regions 90A. Additionally, because the filter holes 91*a* are formed at the communication regions 93, a liquid flow represented by arrows 302 occurs at the communication regions 93.

It is noted that air bubbles accumulated at the reinforcement ribs 92, particularly, the air bubbles accumulated at the reinforcement ribs 92 arranged at the side closer to the individual channels 5, may occasionally flow into the individual channels 5 and cause discharge defects. However, by arranging the reinforcement ribs 92 in the above-described manner, adequate liquid flow may be secured at the reinforcement ribs 92 arranged at the side closer to the individual channels 5 so that accumulation of air bubbles may be prevented and the air bubble discharge performance may be improved.

Figure 7:
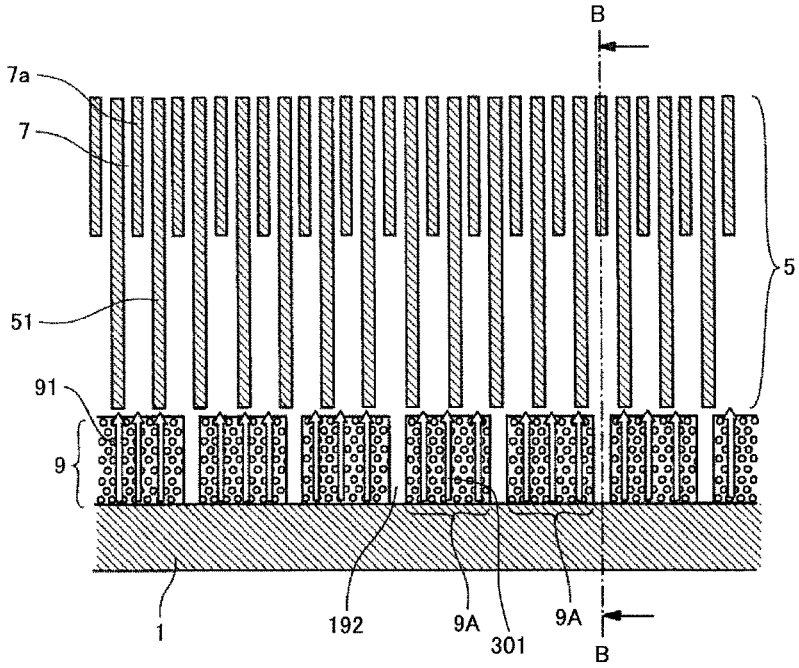
FIG. 7 is a plan view of a channel portion near a liquid supply path of a liquid discharge heat according to a first comparative example.
Figure 8:
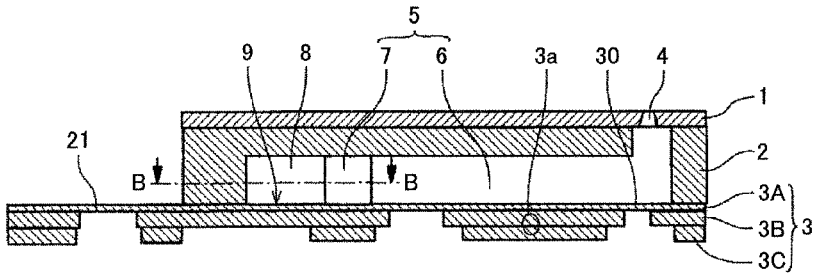
FIG. 8 is a cross-sectional view of the channel portion of the first comparative example across section B-B of FIG. 7.

In the following, a first comparative example is described with reference to FIGS. 7-8. FIG. 7 is a plan view of a channel portion near a liquid supply path 7 of a liquid discharge head according to the first comparative example; and FIG. 8 is a cross-sectional view of the same portion across section B-B of FIG. 7 the position of line B-B of FIG. 8 corresponding to the position of line B-B of FIG. 7).

In the first comparative example, the filter part 9 has plural reinforcement ribs 192 arranged in the nozzle direction as in the above first embodiment. However, in the first comparative example, the reinforcement ribs 192 are arranged across the entire width of the filter part 9 in a direction perpendicular to the nozzle array direction.

In this case, because the filter holes 91*a* are not arranged at the portions where the reinforcement ribs 192 are arranged, stagnant regions where liquid does not flow may be created and air bubbles may easily accumulate at these regions so that the air bubble discharge performance may be degraded.

It is noted that although liquid flow throughout the entire region may be secured in a case where the reinforcement ribs 192 are not arranged, in such a case, stiffness of the filter part 9 may decrease and stable filter functions may not be secured.

According to an aspect of the above first embodiment, by partially arranging the reinforcement ribs 92 over the width of the filter part 9, stagnation of liquid may be prevented and liquid discharge performance may be improved while securing adequate stiffness of the filter part 9 to ensure stable filtering functions.

Figure 9:
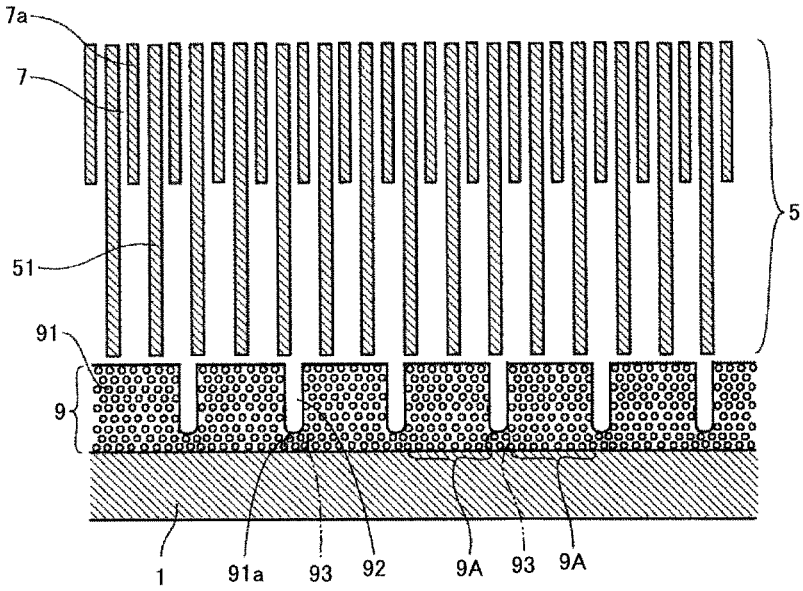
FIG. 9 is a plan view of a channel portion near a liquid supply path of a liquid discharge head according to a second embodiment of the present invention.
Figure 10:
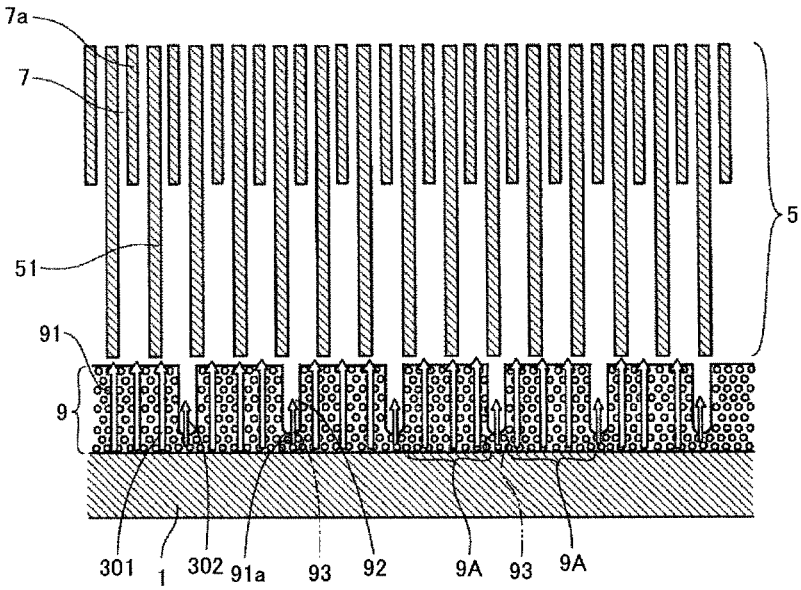
FIG. 10 is a plan view illustrating a liquid flow at the channel portion of the second embodiment.

In the following, a second embodiment of the present invention is described with reference to FIGS. 9-10. FIG. 9 is a plan view of a channel portion near a liquid supply path 7 of a liquid discharge head according to the second embodiment; and FIG. 10 is a plan view illustrating a liquid flow at the same portion.

In the present embodiment, the communication regions 93 are arranged at the opposite side of the individual channels 5. That is, the communication regions 93 including the filter holes 91*a* are positioned at the most upstream side of the filter part 9 with respect to the liquid flow direction of the individual channels 5.

By arranging the reinforcement ribs 92 in the above-described manner, fluid velocity may be secured throughout the entire region of the filter part 9 including regions above the reinforcement ribs 92 so that the air bubble discharge performance may be improved further.

Figure 11:
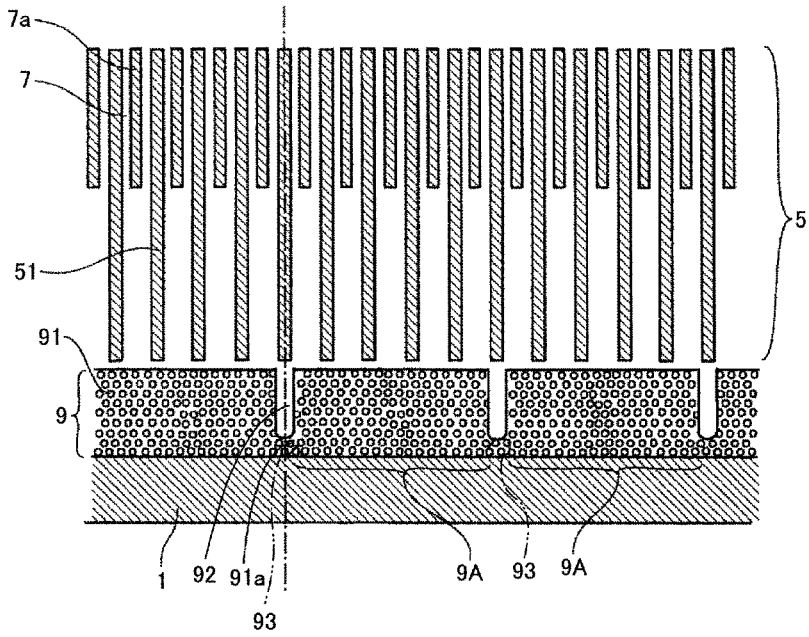
FIG. 11 is a plan view of a channel portion near a liquid supply path of a liquid discharge head according to a third embodiment of the present invention.

In the following, a third embodiment of the present invention is described with reference to FIG. 11. FIG. 11 is a plan view of a channel portion near a liquid supply path 7 of a liquid discharge head according to the third embodiment.

In the present embodiment, the reinforcement ribs 92 are arranged at a position corresponding to the position of the partition walls 51 in the nozzle array direction (as illustrated by a dot-dashed in FIG. 11). In this case, one filter region 9A is arranged to be in communication with plural individual channels 5.

By arranging one filter region 9A for plural individual channels 5, an opening area of the filter part 9 may be increased and pressure loss may be decreased. Also, by arranging the position of the reinforcement ribs 92 to correspond to the positions of the partition walls 51; namely, by arranging the positions of the communication regions 93 between adjacent filter regions 9A to correspond to the positions of the partition walls 51, extending regions of the individual channels 5 may be arranged to correspond to the filter regions 90A of the filter part 9 so that the liquid supply rate to the individual channels 5 may be improved.

It is noted that the positional relation between the reinforcement ribs 92 and the partition walls 51 is not limited to the illustrated example where the center lines of the reinforcement ribs 92 and the partition walls 51 are arranged to correspond. In other examples, at least portions of the reinforcement ribs 92 and the partition walls 51 may be arranged to overlap. In a preferred embodiment, the width of the reinforcement ribs 92 is arranged to be less than the width of the partition walls 51 so that the reinforcement ribs 92 are arranged within the extending regions of the partition walls 51.

Figure 12:
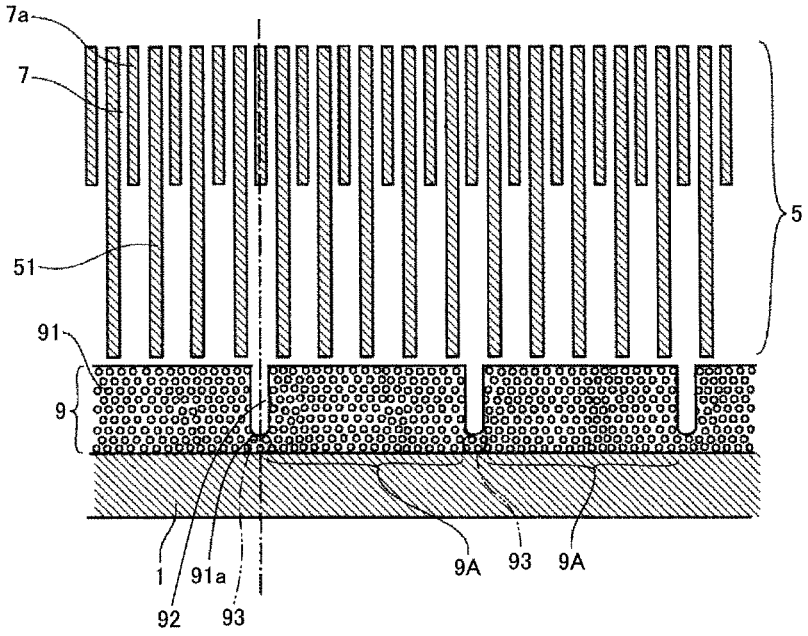
FIG. 12 is a plan view of a channel portion near a liquid supply path of a liquid discharge head according to a fourth embodiment of the present invention.

In the following, a fourth embodiment of the present invention is described with reference to FIG. 12. FIG. 12 is a plan view of a channel portion near a liquid supply path 7 of a liquid discharge head according to the fourth embodiment.

In the present embodiment, the positions of the reinforcement ribs 92 are arranged to correspond to the center positions of the individual channels 5 in the nozzle array direction (as illustrated by a dot-dashed line in FIG. 12).

By arranging the positions of the reinforcement ribs 92 to correspond to the center positions of the individual channels 5; namely, by arranging the positions of the communication regions 93 between adjacent filter regions 9A to correspond to the center positions of the individual channels 5, the reinforcement ribs 92 may be arranged where the fluid velocity is the fastest so that air bubbles accumulated right below the reinforcement ribs 92 may be efficiently discharged.

It is noted that in a case where the reinforcement ribs 92 are shifted from the center positions of the individual channels 5, the greater the deviation from the center positions, the lower the fluid velocity and the more difficult it becomes to secure adequate liquid flow from the upstream side at the region right below the reinforcement ribs 92. As a result, the air bubble discharge performance may be degraded in such case.

It is noted that in other embodiments of the present invention, the features of the above embodiments may be combined, for example. Also, although the filter part 9 is formed by the vibrating plate member 3 in the above embodiments, in other embodiments, a filter member may be arranged to form the filter part 9.

Figure 13:
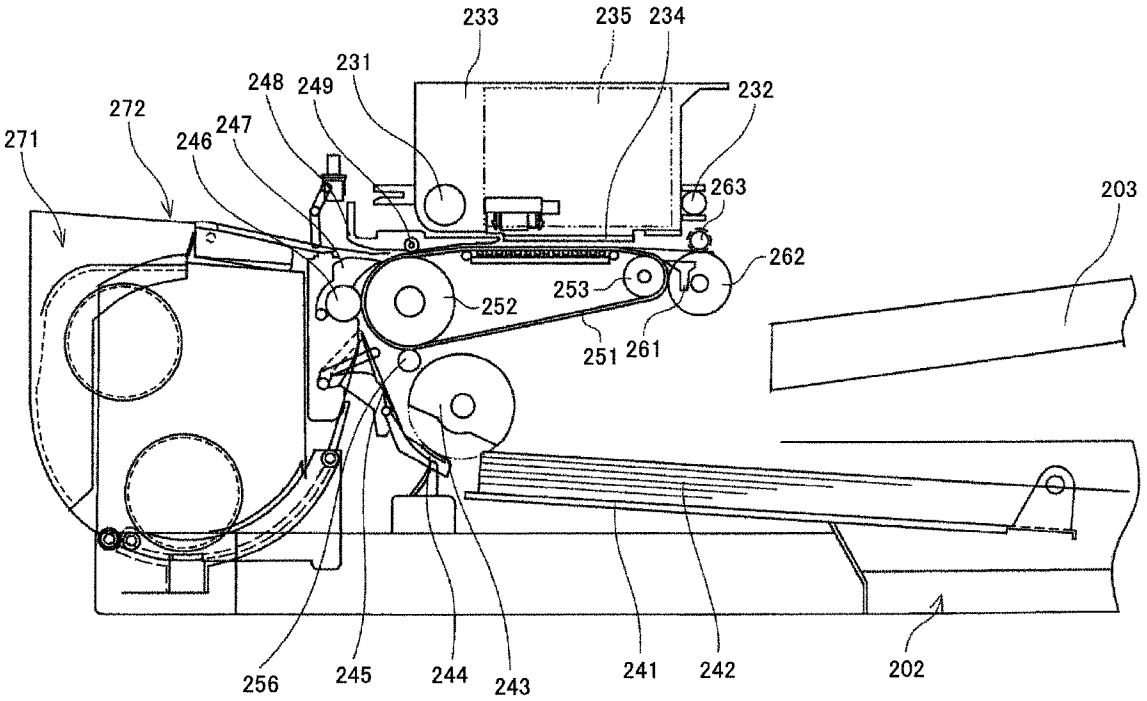
FIG. 13 is a side view of an image forming apparatus including a liquid discharge head according to an embodiment of the present invention.
Figure 14:
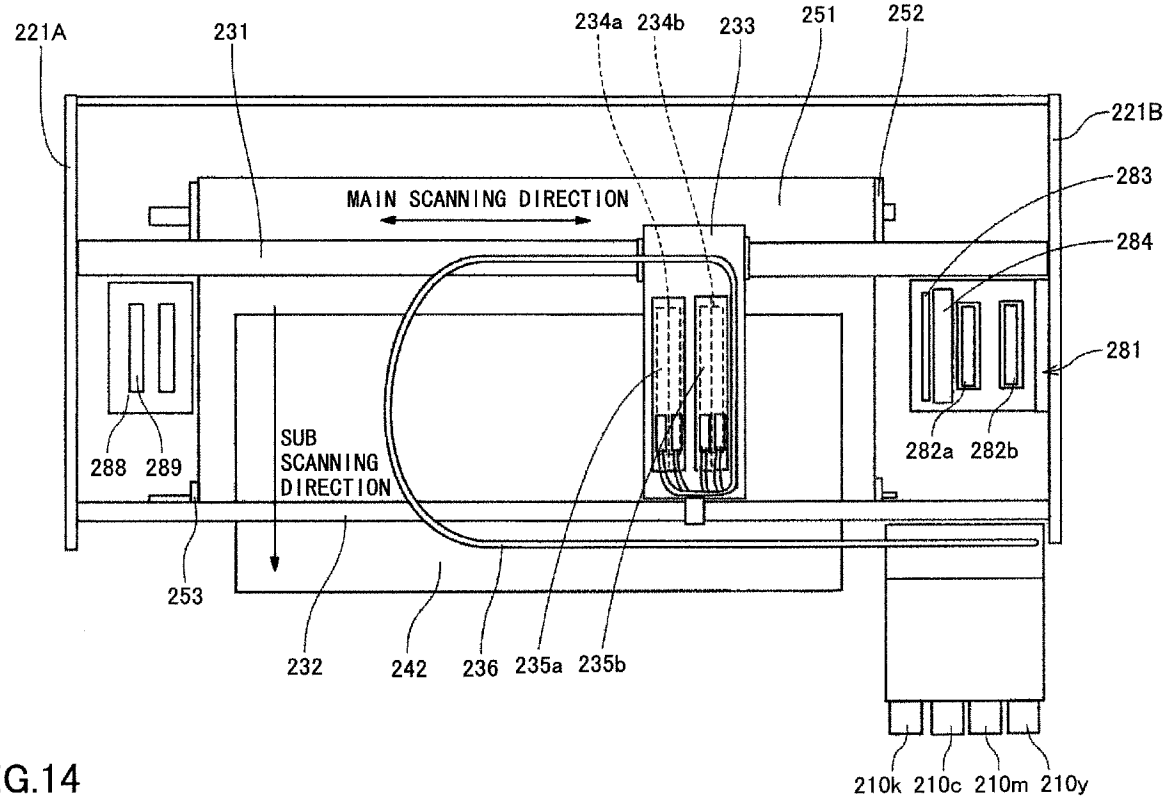
FIG. 14 is a plan view of the image forming apparatus.

In the following, an exemplary configuration of an image forming apparatus including a liquid discharge head according to an embodiment of the present invention is described with reference to FIGS. 13-14. FIG. 13 is a side view of the image forming apparatus; and FIG. 14 is a plan view of the image forming apparatus.

The illustrated image forming apparatus is a serial-type image forming apparatus and includes a main left-side plate 221A, a main right-side plate 221B, a main guide rod 231, a sub guide rod 232, and a carriage 233. The main guide rod 231 and the sub guide rod 232 acting as guide members extend between the main side plates 221A and 221B to support the carriage 233. The carriage 233 supported by the main guide rod 231 and the sub guide rod 232 is slidable in a main scanning direction, which is represented by an arrow labeled "MAIN SCANNING DIRECTION" in FIG. 14.

On the carriage 233 is mounted a recording head 234 including liquid discharge head units 234*a* and 234*b*. Each of the liquid discharge head units 234*a* and 234*b* may include the liquid discharge head according to any of the above-described exemplary embodiments to discharge ink droplets of different colors, for example, yellow (Y), cyan (C), magenta (M), and black (K), and a sub tank integrally molded with the liquid discharge head to store ink supplied to the liquid discharge head. The recording head 234 is mounted on the carriage 233 so that multiple nozzle rows each including multiple nozzles are arranged parallel to a sub scanning direction, which is represented by an arrow labeled "SUB SCANNING DIRECTION" in FIG. 14 and is perpendicular to the main scanning direction, and ink droplets are discharged downward from the nozzles.

In the recording head 234, the liquid discharge head units 234*a* and 234*b* each have two nozzle rows, for example, and one of the liquid discharge head unit 234*a*/234*b* may be arranged to discharge droplets of black (K) ink from one of the nozzle rows and droplets of cyan (C) ink from the other one of the nozzle rows, and the other one of the liquid discharge head unit 234*a*/234*b* may be arranged to discharge droplets of magenta (M) ink from one of the nozzle rows and droplets of yellow (Y) ink from the other one of the nozzle rows. It is noted that although the recording head 234 in the present embodiment is arranged to have two liquid discharge heads for discharging liquid droplets of four colors, the present invention is not limited to such an embodiment. For example, the recording head may have one single liquid discharge head having four nozzle rows that discharge ink droplets of four different colors.

A supply unit replenishes different color inks from corresponding ink cartridges 210 to head tanks 235 (235*a* and 235*b*) of the recording head 234 (234*a* and 234*b*) via supply tubes 236 for the respective color inks.

The image forming apparatus further includes a sheet feed section that feeds a sheet 242 stacked on a sheet stack portion (platen) 241 of a sheet feed tray 202. The sheet feed section further includes a sheet feed roller 243 that separates the sheet 242 from the sheet stack portion 241 and feeds the sheet 242 one at a time and a separation pad 244 that is disposed opposite the sheet feed roller 243. The separation pad 244 is made of a material of a high friction coefficient and urged toward the sheet teed roller 243.

To feed the sheet 242 from the sheet feed section to an area below the recording head 234, the image forming apparatus includes a first guide member 245 that guides the sheet 242, a counter roller 246, a conveyance guide member 247, a regulation member 248 including a front-end press roller 249, and a conveyance belt 251 that electrostatically attracts the sheet 242 and conveys the sheet 242 to a position facing the recording head 234.

The conveyance belt 251 is an endless belt that is looped between a conveyance roller 252 and a tension roller 253 so as to circulate in a belt conveyance direction (sub scanning direction). A charging roller 256 is provided to charge a surface of the conveyance belt 251. The charging roller 256 is arranged to be in contact with the surface of the conveyance belt 251 and is configured to be rotated by the circulation of the conveyance belt 251. When the conveyance roller 252 is rotationally driven by a sub scanning motor via a timing roller (not shown), the conveyance belt 251 circulates in the belt conveyance direction (sub scanning direction).

The image forming apparatus further includes a sheet output section for outputting the sheet 242 having an image formed thereon by the recording head 234. The sheet output section includes a separation claw 261 to separate the sheet 242 from the conveyance belt 251, a first output roller 262, and a second output roller 263. Additionally, a sheet output tray 203 is disposed below the first output roller 262.

A duplex unit 271 is removably mounted on a rear face portion of the image forming apparatus. When the conveyance belt 251 rotates in a reverse direction to move the sheet 242 backwards, the duplex unit 271 receives the sheet 242 and turns the sheet 242 upside down to feed the sheet 242 between the counter roller 246 and the conveyance belt 251. A manual-feed tray 272 is arranged at the top face of the duplex unit 271.

Also, a maintenance unit 281 for maintaining and restoring conditions of the nozzles of the recording head 234 is arranged at a non-print area on one end in the main scanning direction of the carriage 233. The maintenance unit 281 includes cap members 282*a* and 282*b* (hereinafter collectively referred to as "caps 282" unless distinguished) to cover nozzle faces of the recording head 234, a wiping blade 283 acting as a blade member for wiping the nozzle faces of the recording head 234, and a first droplet receiver 284 that stores liquid droplets that are discharged during idle discharge operations in which liquid droplets not contributing to image recording are discharged to discard increased-viscosity recording liquid.

Further, a second droplet receiver 288 is disposed at a non-print area on the other end in the main scanning direction of the carriage 233. The second droplet receiver 288 stores liquid droplets not contributing to image recording that are discharged to discard increased-viscosity recording liquid during image recording operations, for example. The second droplet receiver 288 has openings 289 arranged in parallel with the nozzles rows of the recording head 234.

In the image forming apparatus having the above-described configuration, the sheet 242 is fed one at a time from the sheet feed tray 202, to be guided in a substantially vertically upward direction along the first guide member 245, and conveyed while being sandwiched between the conveyance belt 251 and the counter roller 246. Further, the front tip of the sheet 242 is guided by the conveyance guide 237 and pressed by the front-end press roller 249 against the conveyance belt 251 so that the traveling direction of the sheet 242 is changed approximately 90 degrees.

At this time, plus outputs and minus outputs; i.e., positive and negative supply voltages are alternately applied to the charging roller 250 so that the conveyance belt 251 is charged with an alternating voltage pattern; i.e., an alternating band pattern of positively-charged areas and negatively-charged areas in the sub-scanning direction (belt circulation direction). When the sheet 242 is transferred onto the conveyance belt 251 that is alternately charged with positive and negative charges, the sheet 242 is electrostatically attracted to the conveyance belt 251 and conveyed in the sub scanning direction by the circulation of the conveyance belt 251.

By driving the recording head 234 in response to image signals while moving the carriage 233, ink droplets are discharged on the sheet 242 that is comes to a halt below the recording head 234 to form one line of a desired image. Then, the sheet 242 is moved by a predetermined distance to record a next line image. Upon receiving a signal indicating that the image has been recorded or that the rear end of the sheet 242 has reached the recording area, the recording head 234 finishes the recording operation and outputs the sheet 242 to the sheet output tray 203.

As described above, the image forming apparatus can employ, as the recording head, the liquid discharge head according to any of the above-described exemplary embodiments, thus allowing stable formation of high-quality images.

It is noted that the term "sheet" as used in the above descriptions is not limited to a medium made of paper, but more broadly encompasses any type of medium on which liquid such as ink droplets may be held including an OHP (overhead projector) film, cloth, glass, and a substrate, for example. Moreover, the term generally encompasses any material that may be referred to as a recording medium, a recording sheet, or recording paper, for example. Also, it is noted that the terms "image formation," "recording," and "printing" are used synonymously in the above descriptions.

The term "image forming apparatus" is used to refer to any apparatus that forms an image by discharging liquid on a medium including paper, thread, fiber, cloth, leather, metal, plastic, glass, wood, and ceramic materials, for example. The term "image formation" is not limited to the rendering of an image having meaning such as a character or a figure, but also encompasses the rendering of an image without meaning such as a pattern (e.g., simply dropping liquid droplets on a medium), for example.

The term "ink" as used in the above descriptions is not limited to what is typically referred to as ink, but more broadly encompasses any type of liquid that may be used as an image forming agent including any type of recording liquid or fixing liquid such as DNA samples, resist materials, patterning materials, and resins, for example.

The term "image" as used in the above descriptions is not limited to a planar image and also encompasses an image rendered on a three-dimensional medium as well as an image of a three-dimensional object that is formed using a three-dimensional model, for example.

Further, the present invention is not limited to these embodiments, and numerous variations and modifications may be made without departing from the scope of the present invention.

The present application is based on and claims the benefit of priority to Japanese Patent Application No. 2012-112427 filed on May 16, 2012, the entire contents of which are hereby incorporated by reference.

What is claimed is:

1. A liquid discharge head comprising:

a plurality of nozzles that discharge liquid droplets;

a plurality of individual channels that are in communication with the nozzles;

a liquid introducing part that is in communication with the individual channels;

a common liquid chamber that supplies liquid to the individual channels; and a filter part that is arranged between the common liquid chamber and the liquid introducing part, the filter part having a plurality of tiller holes configured to filter the liquid over a range of the individual channels in a nozzle array direction;

wherein the filter part has at least one einforcement rib arranged in the nozzle array direction;

the reinforcement rib is partially arranged over the range of the filter part in a direction perpendicular to the nozzle array direction;

the reinforcement rib is arranged at a side of the filter part facing toward the common liquid chamber;

the filter part is divided into filter regions by the reinforcement rib and the filter regions are arranged to be in communication via a communication region of the filter part where the reinforcement rib is not arranged; and the filter holes in the communication region are arranged at the same position along the nozzle array direction as the reinforcement rib.

2. The liquid discharge head as claimed in claim 1, wherein the filter regions divided by the at least one reinforcement rib are each arranged to be in communication with more than one of the individual channels in the nozzle array direction.

3. The liquid discharge head as claimed in claim 1, wherein the reinforcement rib is arranged at a position corresponding to a position of a partition wall arranged between the individual channels.

4. The liquid discharge head as claimed in claim 1, wherein the reinforcement ib is arranged ata position corresponding to a center position of one of the individual channels in the nozzle array direction.

5. An image forming apparatus comprising a liquid discharge head that includes:

a plurality of nozzles that discharge liquid droplets;

a plurality of individual channels that are in communication with the nozzles;

a liquid introducing part that is in communication with the individual channels;

a common liquid chamber that supplies liquid to the individual channels; and a filter part that is arranged between the common liquid chamber and the liquid introducing part, the titter part having a plurality of filter holes configured to filter the liquid over a range of the individual channels in a nozzle array direction;

wherein the filter part has at least one reinforcement rib arranged in the nozzle array direction;

the reinforcement rib is partially arranged over he range of the filter part in a direction perpendicular to the nozzle array direction;

the reinforcement rib is arranged at a side of the filter part facing toward the common liquid chamber;

the filter part is divided into filter regions by the reinforcement rib and the filter regions are arranged to be in communication via a communication region of the filter part where the reinforcement rib is not arranged; and the filter holes in the communication region are arranged at the same position along the nozzle array direction as the reinforcement rib.

6. The liquid discharge head as claimed in claim 1, further comprising a wall member that forms a wall of the individual channels, wherein the tilter part is formed in the wall member, and the reinforcement rib is connected to a portion of a wall face of the wall member at an outer periphery of the filter part, in a planar view of the wall member.

7. The liquid discharge head as claimed in claim 6, wherein the reinforcement rib is arranged to be concave with respect to an opposite surface of the wall member which is opposite said wall face of the wall member and forms a peripheral region including the outer periphery of the filter part.

8. The liquid discharge head as claimed in claim 7, wherein the wall member comprises a first layer, a second layer, and a third layer, the reinforcement rib is formed by the first layer and the second layer, and the peripheral region is formed by the first layer, the second layer, and the third layer.

* * * * *